US006568752B1

(12) United States Patent
Lu et al.

(10) Patent No.: US 6,568,752 B1
(45) Date of Patent: May 27, 2003

(54) FOLDABLE CHAIR

(76) Inventors: Chien-Chu Lu, 6F, No. 9, Alley 1, Lane 524, Sec. 5, Chunghsiao E. Rd., Taipei (TW); Wan-Fu Chen, No. 28, Chung Shan Rd., Ruey Fang Chen, Taipei Hsien (TW)

( * ) Notice: Subject to any disclaimer, the term of this patent is extended or adjusted under 35 U.S.C. 154(b) by 0 days.

(21) Appl. No.: 10/218,012

(22) Filed: Aug. 12, 2002

(51) Int. Cl.[7] ..... A47C 4/08
(52) U.S. Cl. ..... 297/42; 297/35; 297/155
(58) Field of Search ..... 297/16.1, 35, 42, 297/59, 155, 43, 46–48

(56) References Cited

U.S. PATENT DOCUMENTS 1,060,503 A * 4/1913 Schmucker ..... 297/155
2,397,322 A * 3/1946 McArthur ..... 297/42
3,212,814 A * 10/1965 Anderson ..... 297/155
4,244,619 A * 1/1981 Yoshimura ..... 297/34
4,645,260 A * 2/1987 Harty et al. ..... 297/35

* cited by examiner

*Primary Examiner*—Peter R. Brown
(74) *Attorney, Agent, or Firm*—Dellett and Walters

(57) ABSTRACT

A foldable chair includes a pair of front legs, a pair of rear legs each connected to a corresponding one of the pair of front legs, a pair of rear legs pivotally connected to a connection plate sandwiched between the pair of rear legs, a seat with multiple protrusions received in corresponding cutouts in each of cross pieces which are respectively and pivotally connected between the front leg and the rear-leg, a first and a second armrest on opposite sides of the seat. A table has two grooves oppositely defined in side faces of the table to correspond to the two guiding pins of the second armrest such that the table is slidable relative to the second armrest and a back is pivotally connected between two rear legs by means of two third connectors.

11 Claims, 7 Drawing Sheets

FOLDABLE CHAIR

BACKGROUND OF THE INVENTION

1. Field of the Invention

The present invention relates to a foldable chair, and more particularly to a foldable chair which is able to be folded so that the chair is compact in size for transportation and storage.

2. Description of Related Art

A conventional baby chair normally is fixed in structure such that whenever the baby chair is stored or transported, the user will have trouble or difficulty trying to place the baby chair in place. To overcome the shortcoming, a collapsible chair is introduced to the market so that the user is able to disassemble the chair to minimize the size when storage or transportation is required. However, the user will still have difficulties trying to assemble every piece of the chair back in position, which requires a lot of manual work and too time consuming. Therefore, an improvement to the existing baby chair is needed.

To overcome the shortcomings, the present invention tends to provide an improved foldable chair to mitigate and obviate the aforementioned problems.

SUMMARY OF THE INVENTION

The primary objective of the present invention is to provide a foldable chair which is able to be folded and unfolded easily when required such that the user can readily accomplish the predetermined objective.

In order to accomplish the objective, the foldable chair has a pair of front legs, a pair of rear legs each connected to a corresponding one of the pair of front legs by two cross pieces respectively, each cross piece being sandwiched between one front leg and one rear leg, a rectangular frame pivotally provided between the pair of front legs-by means of two first connectors respectively sandwiched between the frame and the pair of front legs and a footrest pivotally arranged in the frame;

a pair of rear legs pivotally connected to a connection plate sandwiched between the pair of rear legs by means of two second connectors, a seat with multiple protrusions respectively extending out to be received in a corresponding one of cutouts defined in each of cross pieces which are respectively and pivotally connected between the front leg and the rear leg, the seat being pivotal relative to one of the cross pieces and detachable relative to the other cross piece;

a first and a second armrest provided on opposite sides of the seat, each of the first and the second armrest being securely connected to one of the rear leg and one of the cross pieces, wherein the first armrest has a retaining device provided on a side face of the first armrest, the second armrest has a pair of retaining poles extending upward from a side face of the second armrest, each of the retaining poles has a guiding pin extending out to face each other;

a table having two elongated grooves oppositely defined in side faces of the table to correspond to the two guiding pins of the second armrest respectively such that the table is slidable relative to the second armrest when the two guiding pins are received in the elongated grooves and an extension integrally formed on a bottom face of the table to correspond to the retaining device of the first armrest; and a back pivotally connected between two rear legs by means of two third connectors, whereby the front legs and the rear legs of the chair are able to pivot after the chair and the table are pivoted away from one side of the chair.

Other objects, advantages and novel features of the invention will become more apparent from the following detailed description when taken in conjunction with the accompanying drawings.

DETAILED DESCRIPTION OF THE PREFERRED EMBODIMENT

Figure 1:
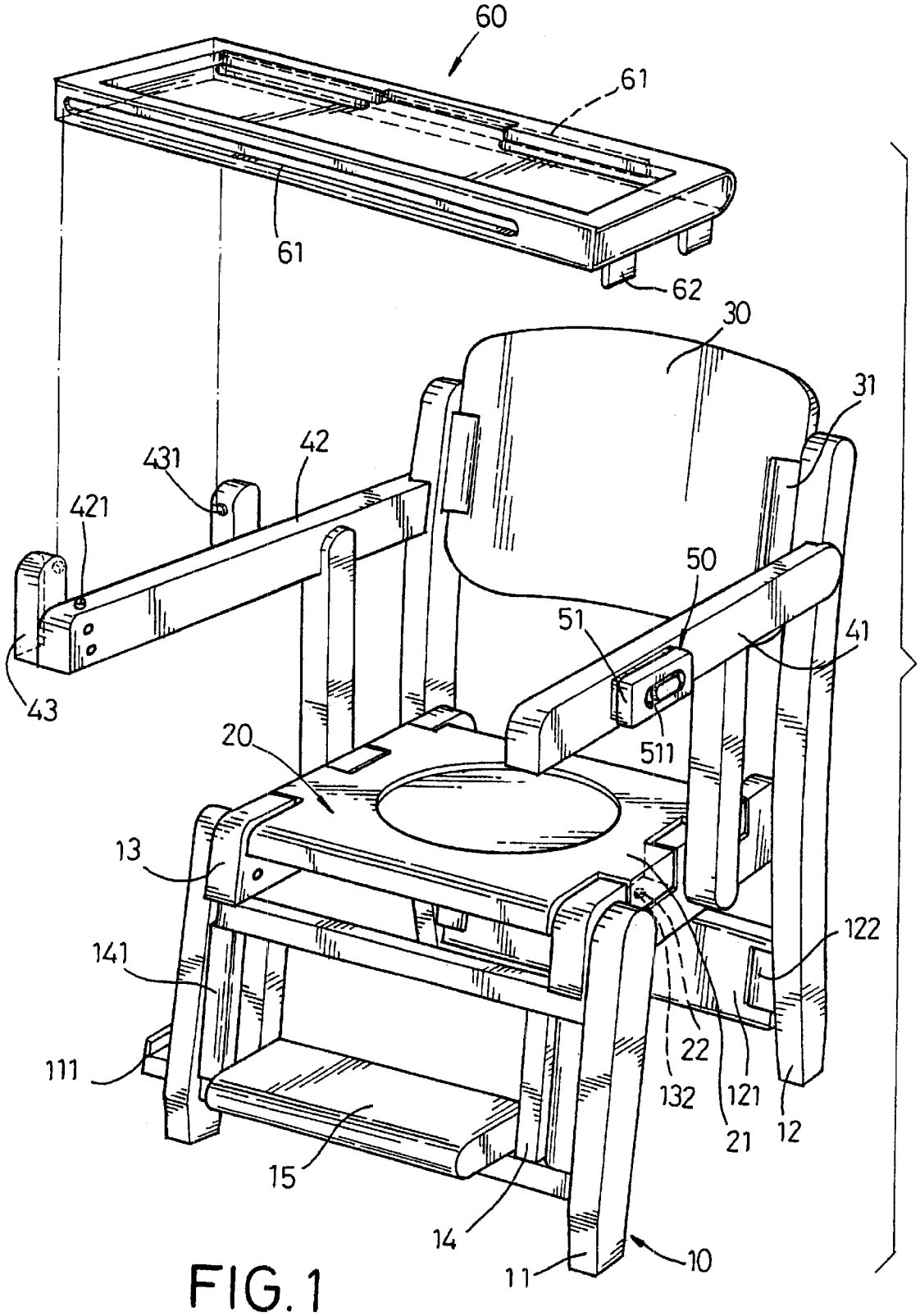
FIG. 1 is an exploded perspective view of the foldable chair of the present invention.

With reference to FIG. 1, the foldable chair in accordance with the present invention has a support (10), a seat (20) and a back (30).

The support (10) has a pair of front legs (11), a pair of rear legs (12) connected to the front legs (11) by two cross pieces (13) each sandwiched between one front leg (11) and one rear leg (12), a rectangular frame (14) pivotally provided between the pair of front legs (11) by means of two first connectors (141) respectively sandwiched between the frame (14) and one of the front legs (11) and a footrest (15) pivotally arranged in the frame (14). The rear legs (12) are pivotally connected to a connection plate (121) sandwiched between the two rear legs (12) by means of two second connectors (122). With the first and second connectors (141,122), the front and rear legs (11,12) are able to pivot relative to the rectangular frame (14) and the connection plate (121) respectively.

Figure 2:
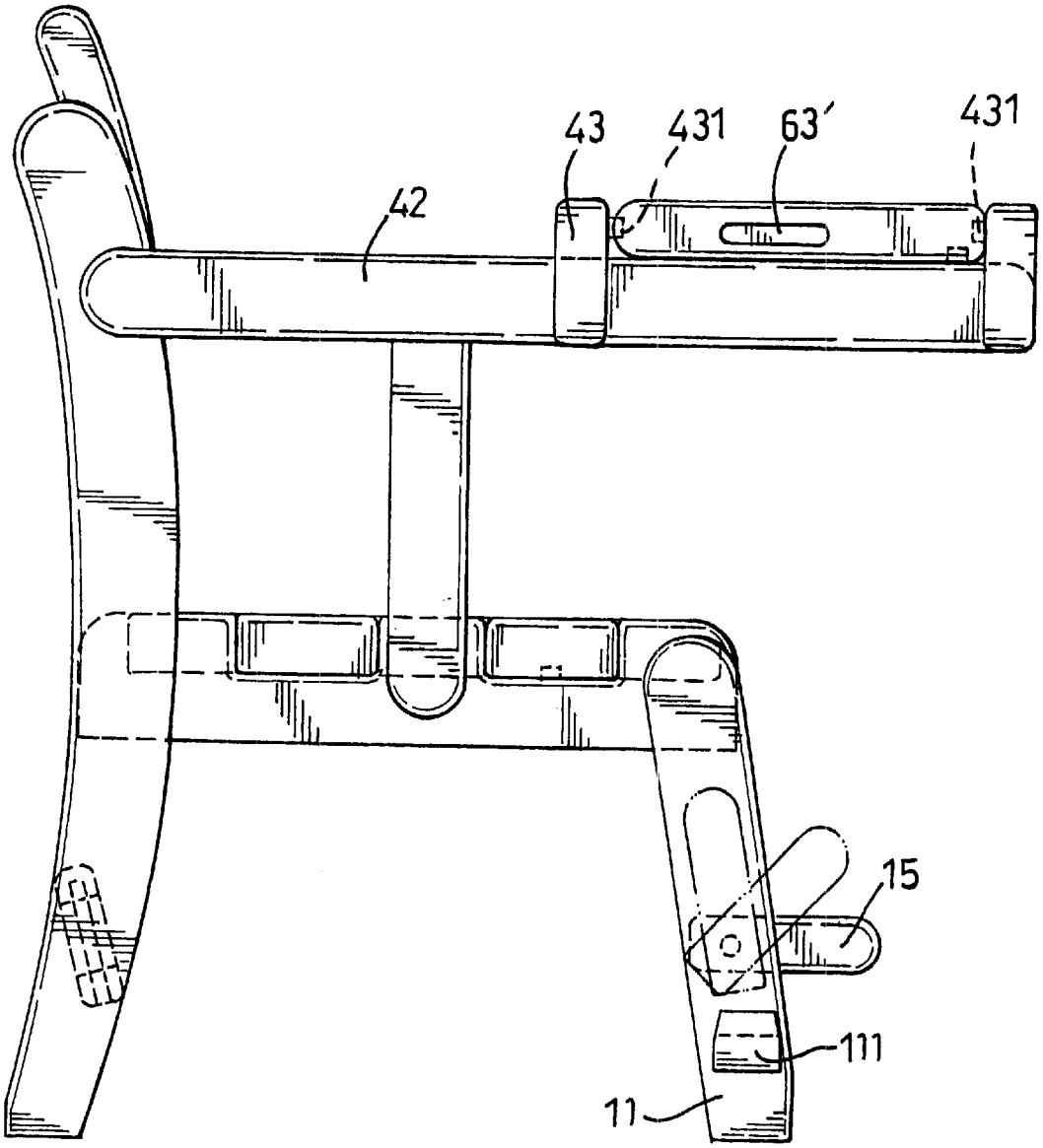
FIG. 2 is a side plan view of the foldable chair in FIG. 1.

The seat (20) has multiple protrusions (21) respectively extending out to be received in a corresponding one of cutouts (131) defined in each of the cross pieces (13). A first and a second armrests (41,42) are provided on opposite sides of the seat (20). Each of the first and the second armrest (40) is securely connected to one of the rear leg (12) and one of the cross piece (13). The first armrest (41) has a retaining device (50) provided on a side face of the first armrest (41). The second armrest (42) has a pair of retaining poles (43) extending upward from a side face of the second armrest (42). Each of the retaining poles (43) has a guiding pin (431) extending out to face each other. A table (60) has two elongated grooves (61) oppositely defined in side faces of the table (60) to correspond to the two guiding pins (431) of the second armrest (42) respectively and an extension (62)

integrally formed on a bottom face of the table (60). It is to be noted from FIG. 2 that the front leg (11) corresponding to the second armrest (42) has a seat (111) securely attached to a side of the front leg (11) to correspond to the table (60). The back (30) is pivotally connected between two rear legs (12) by means of two third connectors (31). Therefore, when the table (60) is assembled to the second armrest (42), the two guiding pins (431) are respectively received in the two elongated grooves (61). Then the table (60) is able to be supported by the first armrest (41) and the second armrest (42). Furthermore, because the footrest (15) is pivotally mounted in the frame (14), when the footrest (15) pivots, the footrest (15) engages with a side face of the frame (14), which stops the pivotal movement of the footrest (15) and therefore provides a stable support for the footrest (15) such that the user is able to have his/her feet rested on the footrest (15). Still, the seat (20) has a notch (22) defined in a side face of the seat (20) to correspond to a boss (132) formed on a bottom face defining the cutout (131) so that when the seat (20) is supported by the two cross pieces (13), the combination of the notch (22) and the boss (132) secures the engagement of the seat (20) with one of the cross piece (13).

Figure 3:
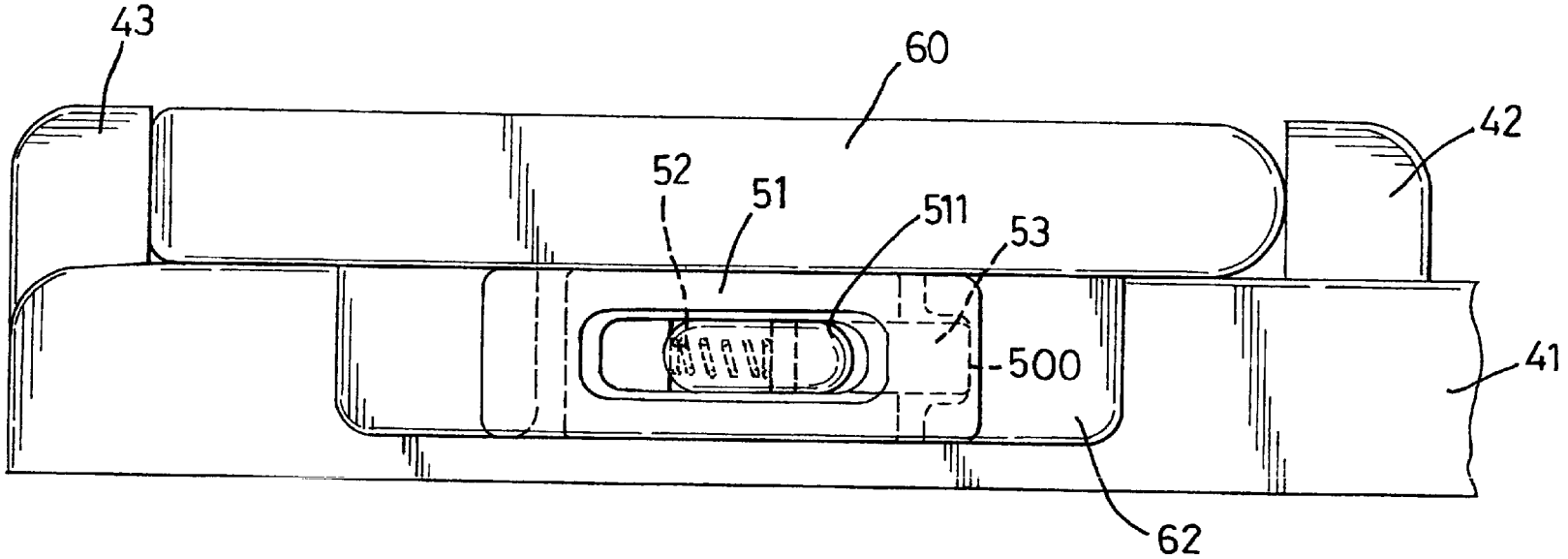
FIG. 3 is a side plan view showing that one of the armrests has a retaining device to detachably secure a table which is pivotal relative to the other armrest.

With reference to FIG. 3, the retaining device (50) includes a hollow casing (51) securely attached to a side face of the first armrest (41) and having a screen (511) defined in a top face of the hollow casing (51) so that the screen (511) communicates with inside of the hollow casing (51). A first distal end of a spring (52) is firmly provided in the hollow casing (51) and a retainer (53) is securely connected to a second distal end of the spring (52) so that the retainer (53) is slidable inside the hollow casing (51) and extend out of the hollow casing (51) from an outlet (500) of the hollow casing (51) to correspond to the extension (62). Therefore, when the table (60) is supported by the first and second armrest (41,42), the extension (62) is able to first force the retainer (53) back into the hollow casing (51) and then the retainer (53) extends out from the outlet (500) to securely retain the table (60).

Figure 4:
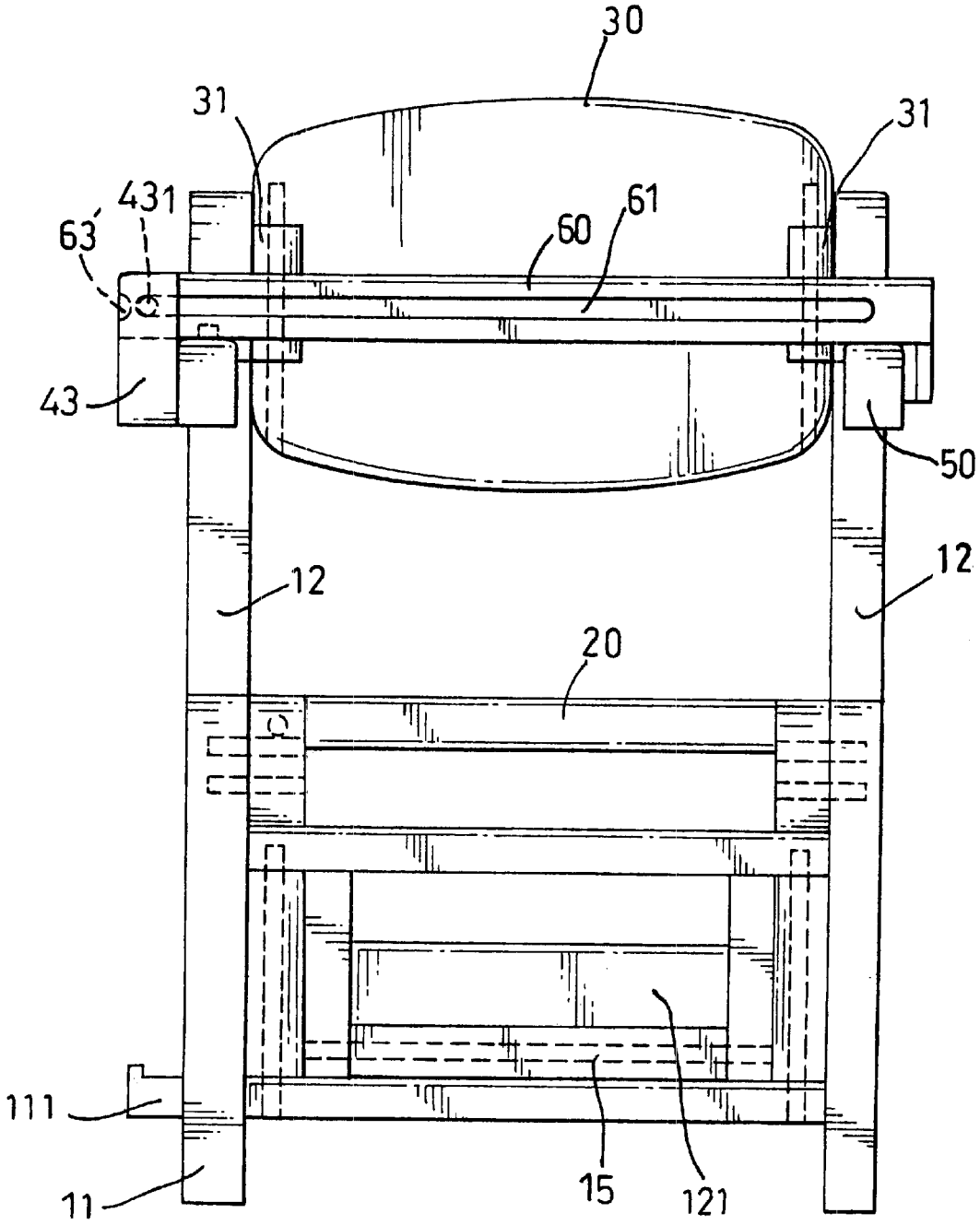
FIG. 4 is a schematic front plan view showing that the table is retained by the retaining device.
Figure 5:
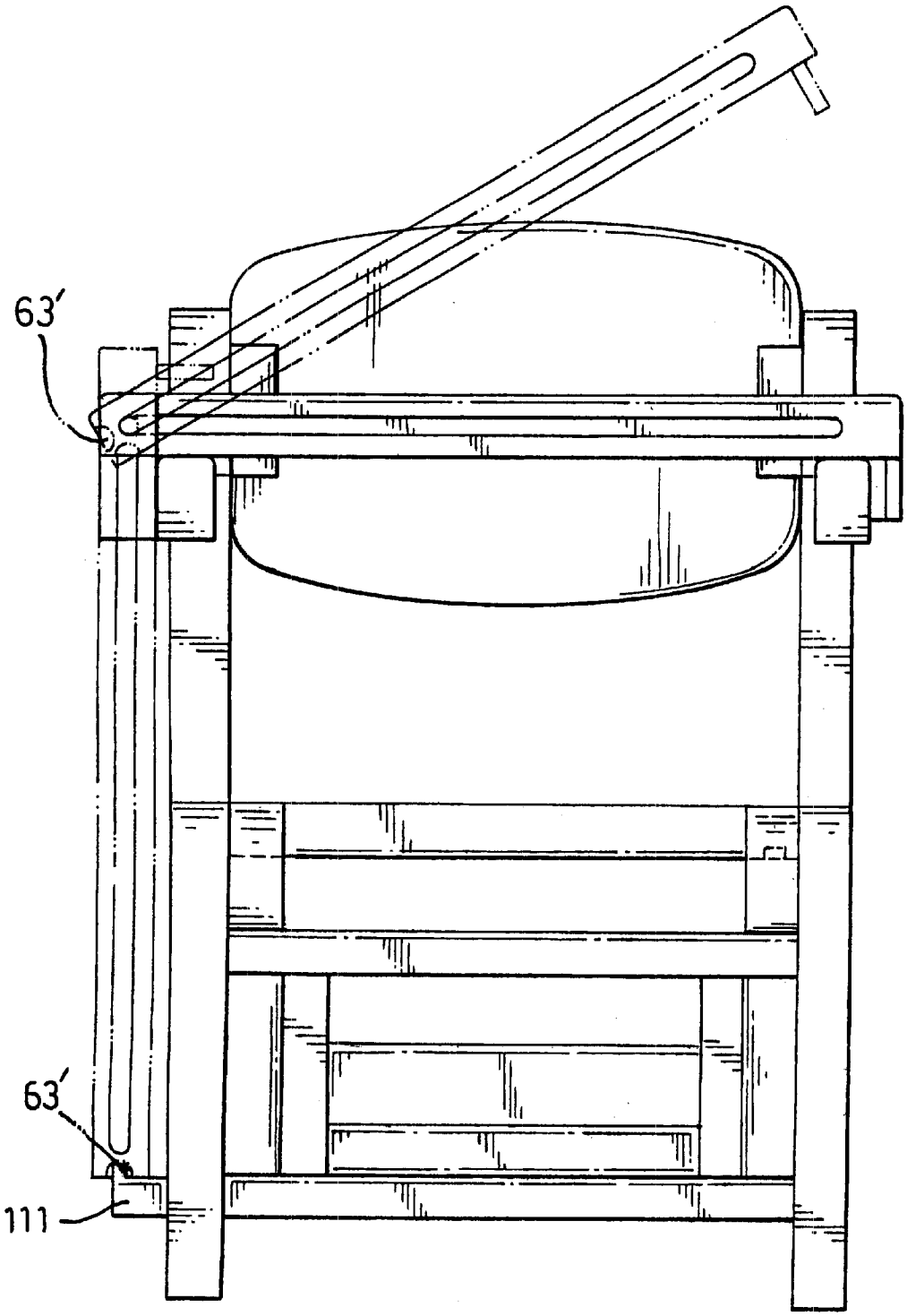
FIG. 5 is a schematic front plan view showing that the table is pivoted and ready for storage.

Furthermore, with reference to FIGS. 4 and 5, when the chair of the present invention is to be folded, the user is able to first move the retainer (53) inward into the hollow casing (51) from engagement with the extension (62) so that the table (60) is able to be raised from one side of the table (60). Due to the provision of the guiding pins (431) on the second armrest (42), the table (60) is able to slide relative to the second armrest (42). When the guiding pins (431) slide to the other ends of the elongated grooves (61), the table (60) slides down along the elongated grooves (61) from a side of the second armrest (42). Because there is a recess (63') defined in a distal end face of the table (60), after the guiding pins (431) slide to the ends of the elongated grooves (61), the corresponding relationship between the recess (63') and the seat (111) secures the table (60) on a side of the second armrest (42).

Figure 6:
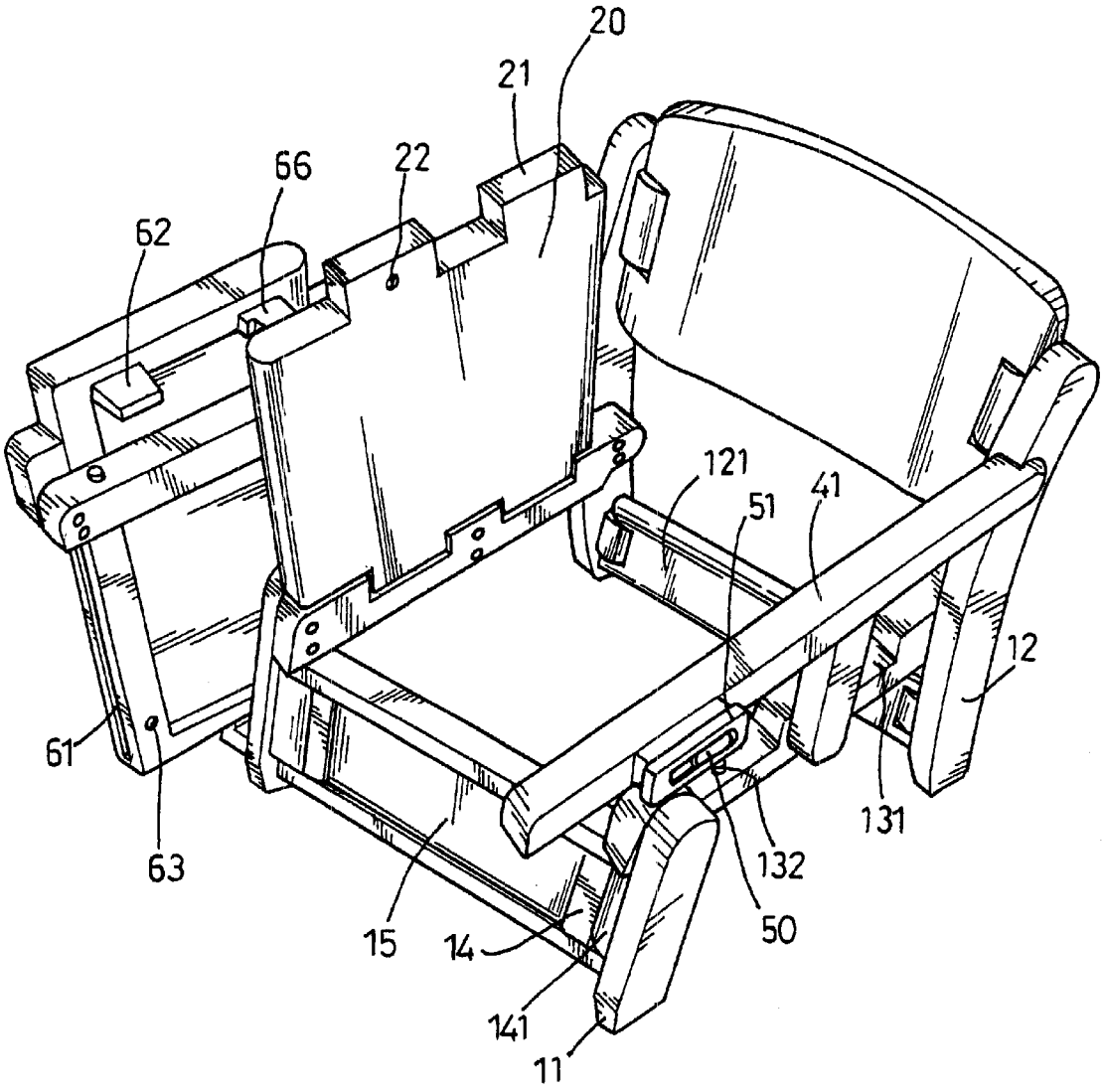
FIG. 6 is a perspective view showing that after the table is put away on one side of the chair, the seat is able to be pivoted for storage of the chair.
Figure 7:
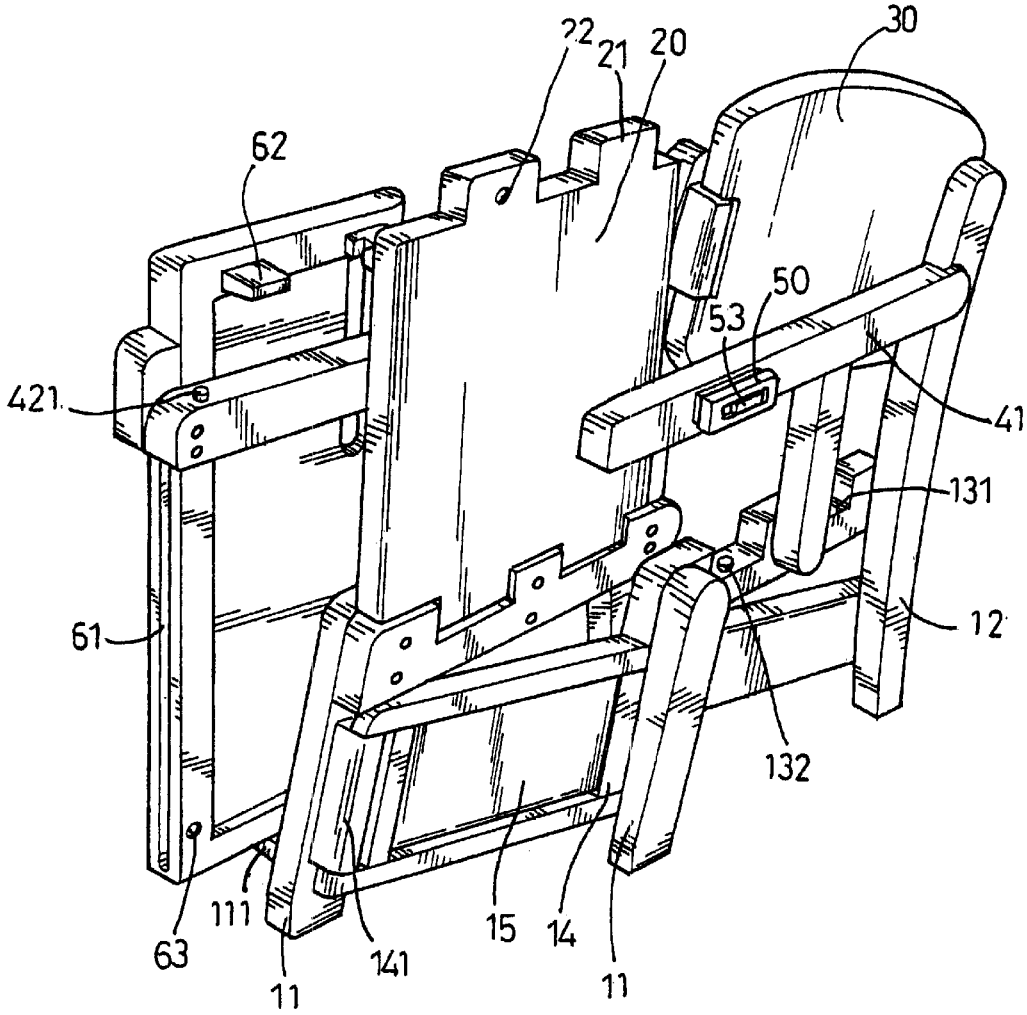
FIG. 7 is a perspective view showing that the foldable chair is fully folded to minimize the size.

With reference to FIGS. 6 and 7 and still taking FIGS. 1, 3, 4 and 5 for reference, when the chair of the present invention is to be folded, the user lifts the table (60) first and the table (60) is slid between the two guiding pins (431) along the elongated grooves (61) to a side of the front leg (11). After the table (60) is slid to the side of the front leg (11), the table (60) is then received and secured in the seat (111). From FIG. 6, it is noted that there is an indentation (63) defined in a bottom face of the table (60) to correspond to a positioning boss (421) in a top face of the second armrest (42) so that when the table (60) is supported by the first and second armrest (41,423, with the positioning boss (421) received in the indentation (63), the table (60) is secured. Further, after the table (60) is received in the seat (111), the user is then able to lift the seat (20) from the first armrest (41). After the lift of the seat (20), due to the first, second and third connectors (141,122,311) the chair is then pivoted in a direction to reduce the size of the chair.

From the foregoing description, it is learned that the chair structure is collapsible such that when storage or transportation of the chair is required, the user may readily fold the chair so as to minimize the dimension to fulfill the requirements. Still, because the table (60) is pivotable so that when the table (60) is not required, the user may put aside the table (60) so that the baby sit in the seat (20) may have free access.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foldable chair comprising:

a pair of front legs, a pair of rear legs each connected to a corresponding one of the pair of front legs by two cross pieces respectively, each cross piece being sandwiched between one front leg and one rear leg, a rectangular frame pivotally provided between the pair of front legs by means of two first connectors respectively sandwiched between the frame and the pair of front legs and a footrest pivotally arranged in the frame;

a pair of rear legs pivotally connected to a connection plate sandwiched between the pair of rear legs by means of two second connectors, a seat with multiple protrusions respectively extending out to be received in a corresponding one of cutouts defined in each of cross pieces which are respectively and pivotally connected between the front leg and the rear leg, the seat being pivotal relative to one of the cross pieces and detachable relative to the other cross piece;

a first and a second armrest provided on opposite sides of the seat, each of the first and the second armrest being securely connected to one of the rear leg and one of the cross pieces, wherein the first armrest has a retaining device provided on a side face of the first armrest, the second armrest has a pair of retaining poles extending upward from a side face of the second armrest, each of the retaining poles has a guiding pin extending out to face each other;

a table having two elongated grooves oppositely defined in side faces of the table to correspond to the two guiding pins of the second armrest respectively such that the table is slidable relative to the second armrest when the two guiding pins are received in the elongated grooves and an extension integrally formed on a bottom face of the table to correspond to the retaining device of the first armrest; and a back pivotally connected between two rear legs by means of two third connectors, whereby the front legs and the rear legs of the chair are able to pivot after the chair and the table are pivoted away from one side of the chair.

2. The foldable chair as claimed in claim 1, wherein the seat has a notch defined in a side face of the seat to correspond to a boss formed on a bottom face defining the cutout so that when the seat is supported by the two cross pieces, the combination of the notch and the boss secures the engagement of the seat with one of the cross piece.

3. The foldable chair as claimed in claim 2, wherein the retaining device includes a hollow casing securely attached to a side face of the first armrest and having a screen defined in a top face of the hollow casing so that the screen communicates with inside of the hollow casing, a spring compressibly received in the hollow casing and a retainer securely connected to a free end of the spring so that the retainer is slidable inside the hollow casing and is able to extend out of the hollow casing from an outlet of the hollow casing to correspond to the extension of the table such that when the table is supported by the first and second armrest, the extension is able to first force the retainer back into the hollow casing and then secured by the retainer extending out from the outlet to securely retain the table.

4. The foldable chair as claimed in claim 3, wherein the table has a recess defined in a distal end of the table to correspond to a seat formed on aside of one of the front legs on a position where the second armrest is located so that after the guiding pins slide to ends of the elongated grooves, the corresponding relationship between the recess and the seat secures the table on a side of the second armrest.

5. The foldable chair as claimed in claim 4, wherein the pair front legs are pivotally connected to the frame by two first connectors, the pair rear legs are pivotally connected to the connection plate by two second connectors and the back is pivotally connected to the rear legs by two third connectors.

6. The foldable chair as claimed in claim 3, wherein the pair front legs are pivotally connected to the frame by two first connectors, the pair rear legs are pivotally connected to the connection plate by two second connectors and the back is pivotally connected to the rear legs by two third connectors.

7. The foldable chair as claimed in claim 2, wherein the table has a recess defined in a distal end of the table to correspond to a seat formed on a side of one of the front legs on a position where the second armrest is located so that after the guiding pins slide to ends of the elongated grooves, the corresponding relationship between the recess and the seat secures the table on a side of the second armrest.

8. The foldable chair as claimed in claim 2, wherein the pair front legs are pivotally connected to the frame by, two first connectors, the pair rear legs are pivotally connected to the connection plate by two second connectors and the back is pivotally connected to the rear legs by two third connectors.

9. The foldable chair as claimed in claim 1, wherein the retaining device, includes a hollow casing securely attached to aside face of the first armrest and having a screen defined in a top face of the hollow casing so that the screen communicates with inside of the hollow casing, a spring compressibly received in the hollow casing and a retainer securely connected to a free end of the spring so that the retainer is slidable inside the hollow casing and is able to extend out of the hollow casing from an outlet of the hollow casing to correspond to the extension of the table such that when the table is supported by the first and second armrest, the extension is able to first force the retainer back into the hollow casing and then secured by the retainer extending out from the outlet to securely retain the table.

10. The foldable chair as claimed in claim 1, wherein the table has a recess defined in a distal end of the table to correspond to a seat formed on a side of one of the front legs on a position where the second armrest is located so that after the guiding pins slide to ends of the elongated grooves, the corresponding relationship between the recess and the seat secures the table on a side of the second armrest.

11. The foldable chair as claimed in claim 1, wherein the pair front legs are pivotally connected to the frame by two first connectors, the pair rear legs are pivotally connected to the connection plate by two second connectors and the back is pivotally connected to the rear legs by two third connectors.

* * * * *